US008741522B2

(12) United States Patent
Arima

(10) Patent No.: US 8,741,522 B2
(45) Date of Patent: Jun. 3, 2014

(54) ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

(75) Inventor: Yasuhiro Arima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/397,111

(22) Filed: Feb. 15, 2012

(65) Prior Publication Data

US 2013/0065173 A1 Mar. 14, 2013

(30) Foreign Application Priority Data

Sep. 9, 2011 (JP) ..... 2011-197117

(51) Int. Cl.
*G03G 9/087* (2006.01)

(52) U.S. Cl.
USPC ..... 430/109.4; 399/222

(58) Field of Classification Search
USPC ..... 430/109.4; 399/222
See application file for complete search history.

(56) References Cited

U.S. PATENT DOCUMENTS

| | | | | |
|---|---|---|---|---|
| 5,624,779 | A * | 4/1997 | Nakayama | 430/110.2 |
| 2005/0250038 | A1 | 11/2005 | McAneney et al. | |
| 2008/0199797 | A1* | 8/2008 | Sacripante et al. | 430/104 |
| 2009/0233216 | A1 | 9/2009 | Teshima | |
| 2010/0183964 | A1* | 7/2010 | Yoshida et al. | 430/107.1 |
| 2010/0203443 | A1* | 8/2010 | Okita et al. | 430/124.1 |

FOREIGN PATENT DOCUMENTS

| | | |
|---|---|---|
| JP | A-2000-284527 | 10/2000 |
| JP | A-2002-365846 | 12/2002 |
| JP | A-2004-151145 | 5/2004 |
| JP | A-2006-11379 | 1/2006 |
| JP | A-2008-203853 | 9/2008 |
| JP | A-2009-237164 | 10/2009 |
| JP | A-2009-258591 | 11/2009 |

* cited by examiner

*Primary Examiner* — Peter Vajda
(74) *Attorney, Agent, or Firm* — Oliff PLC

(57) ABSTRACT

An electrostatic charge image developing toner includes: a polyester resin that has a glass transition temperature of about 45° C. or higher and in which a proportion of repeating units derived from fumaric acid in repeating units derived from acid components is 10 mol % or greater and a proportion of repeating units derived from alkenylsuccinic acid in the repeating units derived from acid components is 10 mol % or greater; and a photopolymerization initiator, wherein a content of the photopolymerization initiator is from about 0.5% by weight to about 10% by weight.

19 Claims, 2 Drawing Sheets

ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2011-197117 filed Sep. 9, 2011.

BACKGROUND

1. Technical Field

The present invention relates to an electrostatic charge image developing toner, an electrostatic charge image developer, a toner cartridge, a process cartridge, an image forming apparatus, and an image forming method.

2. Related Art

As the toner containing a polyester resin with an unsaturated bond and a photopolymerizatton initiator, a toner has been proposed in which by irradiating an image after fixing with light having a wavelength of ultraviolet to visible regions, a curing reaction progresses together with cross-linking and image storability is improved.

SUMMARY

According to an aspect of the invention, there is provided an electrostatic charge image developing toner containing: a polyester resin that has a glass transition temperature of about 45° C. or higher and in which a proportion of repeating units derived from fumaric acid in repeating units derived from acid components is 10 mol % or greater and a proportion of repeating units derived from alkenylsuccinic acid in the repeating units derived from acid components is 10 mol % or greater; and a photopolymerization initiator, wherein a content of the photopolymerization initiator is from about 0.5% by weight to about 10% by weight.

BRIEF DESCRIPTION OF THE DRAWINGS

Exemplary embodiments of the present invention will be described in detail based on the following figures, wherein.

DETAILED DESCRIPTION

Figure 1:
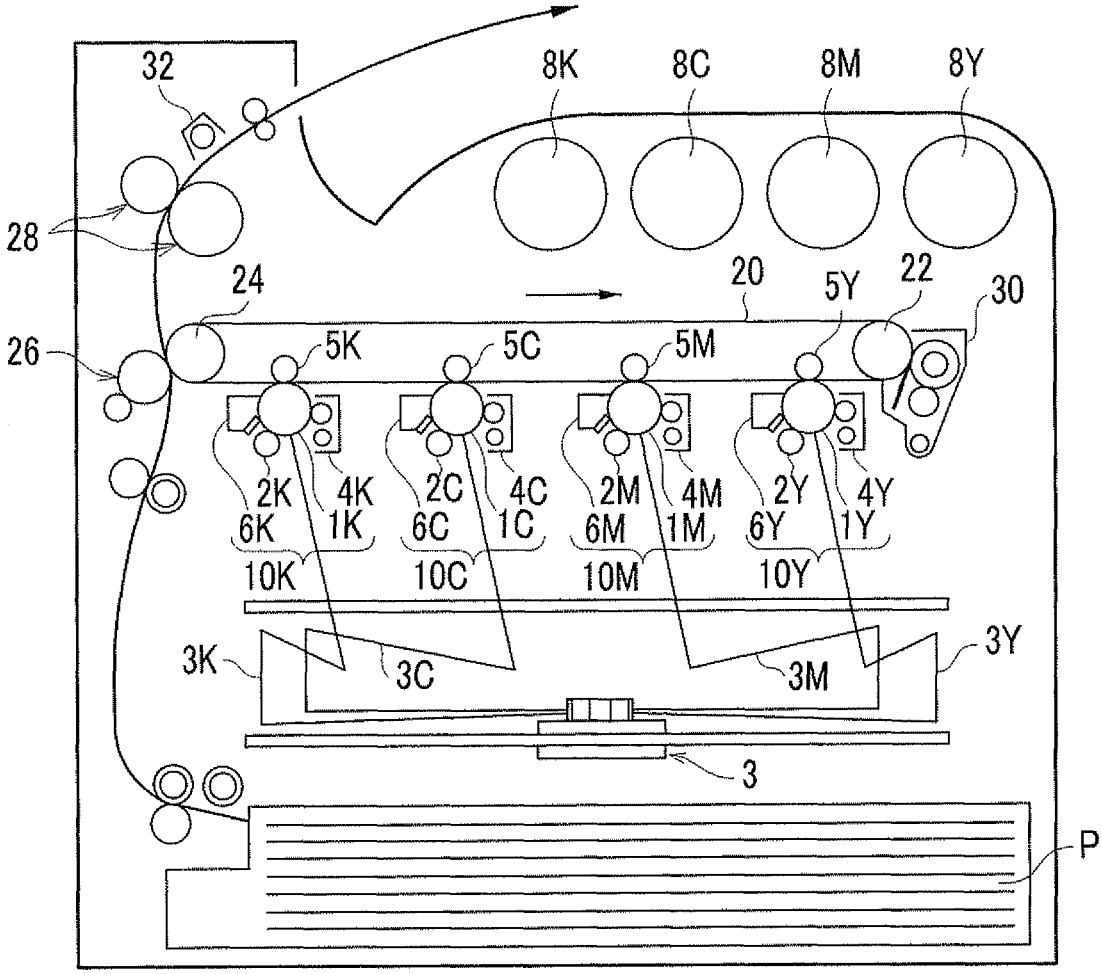
FIG. 1 is a diagram showing the schematic configuration of an example of an image forming apparatus according to an exemplary embodiment.

Hereinafter, an electrostatic charge image developing toner, an electrostatic charge image developer, a toner cartridge, a process cartridge, an image forming apparatus, and an image forming method according to an exemplary embodiment of the invention will be described in detail.

<Electrostatic Charge Image Developing Toner>

An electrostatic charge image developing toner according to this exemplary embodiment (hereinafter, simply referred to as "toner" in some cases) contains a polyester resin that has a glass transition temperature of 45° C. or higher (or about 45° C. or higher) and in which a proportion of repeating units derived from fumaric acid in repeating units derived from acid components is 10 mol % or greater and a proportion of repeating units derived from alkenylsuccinic acid in the repeating units derived from acid components is 10 mol % or greater (hereinafter, referred to as a particular polyester resin in some cases), and from 0.5% by weight to 10% by weight (or from about 0.5% by weight to about 10% by weight) of a photopolymerization initiator.

If necessary, the toner according to this exemplary embodiment may contain a colorant, a release agent, an external additive and other components.

The particular polyester resin that is used in this exemplary embodiment contains a repeating unit derived from fumaric acid and a repeating unit derived from alkenylsuccinic acid as repeating units derived from acid components. Since the fumaric acid and the alkenylsuccinic acid include a polymerizable carbon-carbon double bond (unsaturated bond), the particular polyester resin has a polymerizable unsaturated bond in a main chain and a side chain derived from alkenylsuccinic acid. Since the toner according to this exemplary embodiment contains the photopolymerization initiator in addition to the particular polyester resin, a polymerization reaction occurs between the unsaturated bonds included in the particular polyester resin by light irradiation, and the particular polyester resin is cured.

Here, the resins that are used in the curing reaction are divided broadly into four kinds, that is, unsaturated polyester-based resins, acrylic resins, epoxy-based resins, and urethane-based resins. Among them, unlike the other three kinds of the resins, unsaturated polyester resins may be difficult to use because the resins have a multifunctional monomer that acts to promote the cross-linking due to reactivity and physical property adjustability.

Therefore, in general, unsaturated polyesters are only used to cause a cross-linking reaction by using the unsaturated bond of the main chain to impart a curing reaction.

Specifically, a method of introducing an unsaturated bond for the main chain by using fumaric acid or the like as a constituent monomer of the polyester resin has been proposed.

However, when the curing is carried out only with the unsaturated bond of the main chain, the crosslink density is difficult to increase, and thus it may be difficult to improve the image strength of a toner image.

A toner including a polyester resin as a binder resin is excellent in fixability, particularly, flexibility of an image in comparison to toners including the other three kinds of the resins as a binder resin.

Since the particular polyester resin that is used in this exemplary embodiment has an unsaturated bond also in the side chain in addition to the unsaturated bond of the main chain, the crosslink density is easy to increase. Therefore, a high-strength image is formed by using the toner according to this exemplary embodiment.

—Particular Polyester Resin—

The toner according to this exemplary embodiment contains a particular polyester resin as a binder resin. The particular polyester resin that is used in this exemplary embodiment has a glass transition temperature of 45° C. or higher. In the particular polyester resin, a proportion of repeating units derived from fumaric acid in repeating units derived from acid components is 10 mol % or greater and a proportion of repeating units derived from alkenylsuccinic acid in the repeating units derived from acid components is 10 mol % or greater.

The glass transition temperature of the particular polyester resin is 45° C. or higher. When the glass transition temperature of the particular polyester resin is lower than 45° C., a problem may occur in the heat storage property of the toner. The glass transition temperature of the particular polyester resin is preferably 50° C. or higher. In addition, due to fixability (minimum fixing temperature), the glass transition temperature of the particular polyester resin is preferably 65° C. or lower.

The particular polyester resin is obtained by, for example, condensation polymerization of an acid component and an alcohol component. A residue of the acid component that is generated by condensation polymerization of the acid component and the alcohol component corresponds to the repeating unit derived from the acid component.

Both of a proportion of repeating units derived from fumaric acid and a proportion of repeating units derived from alkenylsuccinic acid in repeating units derived from acid components in the particular polyester resin are adjusted to 10 mol % or greater.

When the proportion of repeating units derived from fumaric acid is less than 10 mol %, the image strength may deteriorate because the formation of cross-linking derived from the main chain skeleton is not sufficient. In addition, when the proportion of repeating units derived from alkenylsuccinic acid is less than 10 mol %, the image strength may deteriorate because the formation of cross-linking derived from the side chain is not sufficient.

The proportion of repeating units derived from fumaric acid in repeating units derived from acid components is preferably 25 mol % or greater. In addition, the proportion of repeating units derived from alkenylsuccinic acid in the repeating units derived from acid components is preferably 25 mol % or greater.

A ratio of the proportion of repeating units derived from fumaric acid and the proportion of repeating units derived from alkenylsuccinic acid in the repeating units derived from acid components is not particularly limited. However, for example, the molar ratio of them (repeating units derived from fumaric acid: repeating units derived from alkenylsuccinic acid) is preferably from 5:1 to 1:5, and more preferably from 4:1 to 1:4.

The upper limits of the proportion of repeating units derived from fumaric acid and the proportion of repeating units derived from alkenylsuccinic acid are not particularly limited. The glass transition temperature of the polyester resin is set to be 45° C. or higher, but for example, the proportion of repeating units derived from fumaric acid in the repeating units derived from acid components is preferably 40 mol % or less, and the proportion of repeating units derived from alkenylsuccinic acid in the repeating units derived from acid components is preferably 40 mol % or less.

In this exemplary embodiment, examples of the alkenylsuccinic acid that is the origin of repeating units derived from alkenylsuccinic acid include dodecenylsuccinic acid, pentadecenylsuccinic acid, and the like.

In this exemplary embodiment, it is desirable that a repeating unit derived from dodecenylsuccinic acid is used as a repeating unit derived from alkenylsuccinic acid. The reason is that dodecenylsuccinic acid that is an acid component desirably reacts and is easy to obtain.

In this exemplary embodiment, at least fumaric acid and alkenylsuccinic acid are used as acid components in synthesis of the particular polyester resin. However, if necessary, other acid components may be used in combination to adjust the glass transition temperature of the particular polyester resin. Examples of other acid components include aromatic carboxylic acids such as terephthalic acid, isophthalic acid, phthalic anhydride, trimellitic anhydride, pyromellitic acid and naphthalenedicarboxylic acid; aliphatic carboxylic acids such as maleic acid, succinic acid and adipic acid; and alicyclic carboxylic acids such as cyclohexanedicarboxylic acid. For the purpose of securing good fixability, tri- or higher-valent carboxylic acids (trimellitic acid and its anhydride) may be used in combination with dicarboxylic acid in order to employ a cross-linked structure or a branched structure.

Examples of the alcohol component that may be used in this exemplary embodiment include aliphatic diols such as ethylene glycol, diethylene glycol, triethylene glycol, propylene glycol, butanediol, hexanediol, neopentyl glycol and glycerin; alicyclic diols such as cyclohexanediol, cyclohexanedimethanol and hydrogenerated bisphenol-A; and aromatic diols such as ethylene oxide adducts of bisphenol A and propylene oxide adducts of bisphenol A. These may be used singly or in combination of two or more kinds.

Among these alcohol components, aromatic diols and alicyclic diols are preferably used, and aromatic diols are more preferably used. In addition, for the purpose of securing better fixability, tri- or higher-valent alcohols (for example, glycerin, trimethylolpropane and pentaerythritol) may be used in combination with the diol in order to employ a cross-linked structure or a branched structure.

Monocarboxylic acid and/or monoalcohol may be added to a particular polyester resin that is obtained by polycondensation of an acid component and an alcohol component to esterify a hydroxyl group and/or a carboxyl group of a polymerization terminal and adjust the acid value of the polyester resin. Examples of the monocarboxylic acid include acetic acid, acetic anhydride, benzoic acid, trichloroacetic acid, trifluoroacetic acid, propionic anhydride, and the like. Examples of the monoalcohol include methanol, ethanol, propanol, octanol, 2-ethylhexanol, trifluoroethanol, trichloroethanol, hexafluoroisopropanol, phenol, and the like.

The acid value of the particular polyester resin is preferably from 5 mgKOH/g to 25 mgKOH/g. When the acid value is 5 mgKOH/g or greater, the toner has good affinity to paper and a good electrostatic property. In addition, when the toner is manufactured by an emulsion aggregation method to be described later, emulsion particles are easily prepared, and the rate of aggregation in an aggregation process and the rate of shape change in a coalescence process in the emulsion aggregation method are suppressed from excessively increasing, whereby the particle size and shape are easily controlled. In addition, when the acid value of the polyester resin is 25 mgKOH/g or less, environmental dependence of charging is not adversely affected. In addition, the aggregation rate in the aggregation process and the rate of shape change in the coalescence process in the toner manufacturing in the emulsion aggregation method are suppressed from being excessively lowered, and thus it is possible to prevent the productivity from being lowered.

The acid value of the polyester resin is more preferably from 6 mgKOH/g to 23 mgKOH/g.

The weight average molecular weight (Mw) of the particular polyester resin, that is obtained by molecular weight measurement of a tetrahydrofuran (THF) soluble fraction using gel permeation chromatography (GPC), is preferably from 5,000 to 1,000,000, and more preferably from 7,000 to 500,000, and the number average molecular weight (Mn) is preferably from 2,000 to 100,000, and the molecular weight distribution Mw/Mn is preferably 1.5 to 100, and more preferably 2 to 60.

The particular polyester resin that is used in this exemplary embodiment may be manufactured by subjecting an acid component to a condensation reaction with an alcohol component in a usual manner. For example, the acid component, the alcohol component, and if necessary, a catalyst are put and mixed in a reaction container provided with a thermometer, a stirrer and a flow-down-type condenser, and heated at from 150° C. to 250° C. in the presence of an inert gas (nitrogen gas or the like). The low-molecular compound that is collaterally generated is continuously removed to the outside of the reaction system, and the reaction is stopped at the time when an acid value set in advance is reached. Then, cooling is performed to acquire a target reaction product.

Since the molar ratio (acid component/alcohol component) in the reaction between an acid component and an alcohol component varies with reaction conditions and the like, it may not be stated definitely. However, for high molecular weight, the molar ratio is preferably about 1/1.

Examples of a catalyst that is used in synthesis of the polyester resin include esterified catalysts such as organic metals such as dibutyltin dilaurate and dibutyltin oxide and metal alkoxides such as tetrabutyl titanate. The amount of the catalyst added is in the range of from 0.01% by weight to 1.00% by weight with respect to a total amount of the raw material.

In this exemplary embodiment, as a binder resin, other resins may be used in combination with the particular polyester resin. Examples of other resins that are used in the toner according to this exemplary embodiment include known thermoplastic binder resins and the like, and specific examples thereof include homo- or copolymers of styrenes such as styrene, parachlorostyrene and α-methylstyrene (styrene-based resins); homo- or copolymers of esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate (vinyl-based resins); homo- or copolymers of vinyl nitriles such as acrylonitrile and methacrylonitrile (vinyl-based resins); homo- or copolymers of vinyl ethers such as vinyl methyl ether and vinyl isobutyl ether (vinyl-based resins); homo- or copolymers of vinyl ketones such as vinyl methyl ketone, vinyl ethyl ketone and vinyl isopropenyl ketone (vinyl-based resins); homo- or copolymers of olefins such as ethylene, propylene, butadiene and isoprene (olefin-based resins); non-vinyl condensation resins such as epoxy resins, polyurethane resins, polyamide resins, cellulose resins and polyether resins; graft polymers of the non-vinyl condensation resins and vinyl monomers, and the like.

These resins may be used singly or in combination of two or more kinds. Among these resins, vinyl-based resins may be used.

It is desirable to use vinyl-based resins from the viewpoint that a resin particle dispersion is easily prepared by emulsion polymerization or seed polymerization using an ionic surfactant or the like. Examples of the vinyl-based monomer include monomers that are raw materials of vinyl-based polymer acids and vinyl-based polymer bases such as acrylic acid, methacrylic acid, maleic acid, cinnamic acid, fumaric acid, vinyl sulfonic acid, ethylenimine, vinylpyridine and vinylamine.

The content of the particular polyester resin in the toner according to this exemplary embodiment is preferably from 50% by weight to 95% by weight, and more preferably from 60% by weight to 90% by weight.

—Photopolymerization Initiator—

The toner according to this exemplary embodiment contains from 0.5% by weight to 10% by weight of a photopolymerization initiator. When the content of the photopolymerization initiator is less than 0.5% by weight, a toner image may not be sufficiently cured and the image strength may not be obtained. In addition, when the content of the photopolymerization initiator is greater than 10% by weight, problems may occur such as deterioration in the electrostatic property and heat storage property.

The content of the photopolymerization initiator is preferably from 2% by weight to 8% by weight.

It is desirable that the photopolymerization initiator that is used in this exemplary embodiment is a radical polymerization initiator. The polymerization reaction between unsaturated bonds included in the particular polyester resin is effectively promoted by using a radical polymerization initiator.

The solubility of the photopolymerization initiator in water at 25° C. is preferably 0.1% by weight or less. When the solubility in water at 25° C. is less than 0.1% by weight, the photopolymerization initiator is difficult to be phase-transferred to an aqueous phase in the manufacturing of a toner by an emulsion aggregation method to be described later, the toner may be allowed to contain the photopolymerization initiator, and the image strength may be increased.

The kind of the photopolymerization initiator is not particularly limited. Common photopolymerization initiators may be used such as an alkylphenone-based compound, an acylphosphine oxide-based compound, an acetophenone-based compound, a benzoin-based compound, a benzophenone-based compound, a thioxanthone-based compound, a diazonium-based compound, a sulfonium salt-based compound, an iodonium salt-based compound and a selenium salt-based compound.

Among them, at least one of an alkylphenone-based compound having a melting temperature of 60° C. or higher and an acylphosphine oxide-based compound having a melting temperature of 60° C. or higher is preferably used. When the melting temperature of the photopolymerization initiator is 60° C. or higher, the aggregation of resin particles and the like in the creating of aggregated particles is easily controlled in the manufacturing of a toner by an emulsion aggregation method to be described later. In addition, the image strength of a toner may be improved by using at least one of an alkylphenone-based compound and an acylphosphine oxide-based compound as a photopolymerization initiator.

Specific examples of an alkylphenone-based compound include 2,2-dimethoxy-1,2-diphenylethan-1-one and 1-hydroxy-cyclohexyl-phenyl-ketone. Among them, 2,2-dimethoxy-1,2-diphenylethan-1-one is preferably used.

Specific examples of an acylphosphine oxide-based compound include bis(2,4,6-trimethylbenzoyl)-phenylphosphine oxide, bis(2,6-dimethoxybenzoyl)-2,4,4-trimethyl-pentylphosphine oxide, and the like. Among them, bis(2,4,6-trimethylbenzoyl)-phenylphosphine oxide is preferably used.

2,2-dimethoxy-1,2-diphenylethan-1-one has absorption from about 365 nm to a short wavelength side, and bis(2,4,6-trimethylbenzoyl)-phenylphosphine oxide has absorption from about 435 nm to a short wavelength side. Here, the light applied by an irradiation unit is more easily scattered as its wavelength becomes shorter. Accordingly, it is difficult for the light having a short wavelength among the applied light to penetrate a toner image, and it is easy for the light having a long wavelength to penetrate a toner image. Therefore, bis(2,4,6-trimethylbenzoyl)-phenylphosphine oxide having absorption in a longer wavelength side easily cures the inside of a toner image, and 2,2-dimethoxy-1,2-diphenylethan-1-one having absorption in a shorter wavelength side easily cures the surface of a toner image. Accordingly, by using 2,2-dimethoxy-1,2-diphenylethan-1-one and bis(2,4,6-trimethylbenzoyl)-phenylphosphine oxide in combination, the inside and surface of a toner image may be cured.

—Colorant—

If necessary, the toner according to this exemplary embodiment may contain a colorant.

The colorant may be a dye or a pigment. However, the colorant is preferably a pigment from the viewpoint of light resistance and water resistance.

Known pigments are used such as carbon black, aniline black, aniline blue, charcoal blue, chromium yellow, ultramarine blue, Dupont oil red, quinoline yellow, methylene blue chloride, phthalocyanine blue, malachite green oxalate, lamp black, Rose Bengal, quinacridone, benzidine yellow, C.I. Pigment Red 48:1, C.I. Pigment Red 57:1, C.I. Pigment Red 122, C.I. Pigment Red 185, C.I. Pigment Red 238, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1 and C.I. Pigment Blue 15:3.

The content of a colorant in the toner according to this exemplary embodiment is preferably from 1 part by weight to 30 parts by weight with respect to 100 parts by weight of a binder resin.

If necessary, a surface-treated colorant is used, or a colorant dispersant is also effectively used. A yellow toner, a magenta toner, a cyan toner, a black toner and the like are obtained by selecting the kind of the colorant.

—Release Agent—

If necessary, the toner according to this exemplary embodiment may contain a release agent.

Examples of the release agent include paraffin waxes such as low-molecular weight polypropylene and low-molecular weight polyethylene; silicone resins; rosins; rice waxes; carnauba waxes and the like. The melting temperature of the release agents is preferably from 50° C. to 100° C., and more preferably from 60° C. to 95° C.

The content of the release agent in the toner is preferably from 0.5% by weight to 15% by weight, and more preferably from 1.0% by weight to 12% by weight. When the content of the release agent is 0.5% by weight or greater, particularly, release defects in oilless fixing are prevented. When the content of the release agent is 15% by weight or less, deterioration in fluidity of the toner is prevented, and thus the image quality and the reliability in image formation are kept.

—Other Additives—

If necessary, various components, such as an internal additive, a charge-controlling agent, an inorganic powder (inorganic particles) and organic particles, other than the above-described components may be added to the toner according to this exemplary embodiment.

Examples of the internal additive include magnetic materials, such as metals such as reduced iron, cobalt, nickel and manganese, alloys thereof and compounds containing the metals such as ferrite, magnetite.

Examples of the charge-controlling agent include quaternary ammonium salt compounds, nigrosine-based compounds, dyes containing a complex of aluminum, iron, chromium and the like, triphenylmethane-based pigments, and the like.

Inorganic particles are added for various purposes, and may also be added to adjust viscoelasticity of the toner. The image gloss and the permeation to paper are adjusted by adjusting the viscoelasticity. As the inorganic particles, known inorganic particles, such as silica particles, titanium oxide particles, alumina particles, cerium oxide particles or any of the particles having a surface subjected to a hydrophobizing treatment, may be used singly or in combination of two or more kinds. Silica particles having a smaller refractive index than the binder resin are preferably used from the viewpoint of maintaining color developability and transparency such as OHP transmittance. Further, silica particles may be subjected to various surface treatments, and it is desirable to use silica particles surface-treated using, for example, a silane-based coupling agent, a titanium-based coupling agent or silicone oil.

—External Additive—

An external additive formed of inorganic or organic particles may be added to the toner according to this exemplary embodiment.

Examples of inorganic particles include silica, alumina, titanium oxide (titania), barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, zirconium oxide, silicon carbide, silicon nitride, and the like. Among them, silica particles and titanium oxide particles may be used, or particles subjected to a hydrophobizing treatment may be used.

In general, inorganic particles are used for the purpose of improving fluidity. The primary particle size of the inorganic particles is preferably from 1 nm to less than 200 nm. The amount added may be from 0.01 part by weight to 20 parts by weight with respect to 100 parts by weight of the toner.

In addition, in general, organic particles are used for the purpose of improving cleanability and transferability, and specific examples thereof include polystyrene, polymethylmethacrylate, polyvinylidene fluoride, and the like.

—Physical Properties of Toner—

The melting temperature of the toner is not particularly limited. It may be in the range of from 45° C. to 110° C., or may be in the range of from 60° C. to 90° C.

When the melting temperature is lower than 45° C. corresponding to a lower limit temperature under a general high-temperature environment to which the toner is exposed when being stored or after forming an image, blocking may be easily caused. The toner causes blocking when being stored under a temperature environment of equal to or higher than the melting temperature because the viscosity is lowered with the melting temperature as a boundary line. On the other hand, when the melting temperature is higher than 110° C., it may be difficult to achieve low-temperature fixing.

The melting temperature is obtained as a melting peak temperature in input compensation differential scanning calorimetry on the basis of JIS K-7121.

The volume average particle size of the toner according to this exemplary embodiment may be from 1 μm to 20 μm, or from 2 μm to 8 μm. The number average particle size may be from 1 μm to 20 μm, or from 2 μm to 8 μm.

Here, the volume average particle size and the number average particle size are measured using a Coulter Multisizer II (manufactured by Beckman Coulter, Inc.). ISOTON-II (manufactured by Beckman Coulter, Inc.) is used as an electrolyte.

In the measurement, from 0.5 mg to 50 mg of a measurement sample is added to 2 ml of a 5% by weight aqueous solution of a surfactant as a dispersant, for example, sodium alkylbenzene sulfonate. The obtained mixture is added to from 100 ml to 150 ml of an electrolyte.

The electrolyte in which the sample is suspended is subjected to a dispersion treatment for 1 minute with an ultrasonic dispersing machine, and the Coulter Multisizer II measures a particle size distribution of particles of from 2 μm to 50 μm by using an aperture having an aperture diameter of 100 μm. 50,000 particles are sampled.

On the basis of the particle size distributions measured in this manner, a cumulative distribution is drawn from the smallest diameter side for the volume and the number with respect to divided particle size ranges (channels). The particle sizes corresponding to 16% in the cumulative distributions are defined as a cumulative volume particle size D16v and a cumulative number particle size D16p, the particle sizes corresponding to 50% in the cumulative distributions are defined as a cumulative volume average particle size D50v and a cumulative number average particle size D50p, and the particle sizes corresponding to 84% in the cumulative distributions are defined as a cumulative volume particle size D84v and a cumulative number particle size D84p.

Here, the volume average particle size is obtained as a cumulative volume average particle size D50v, and the number average particle size is obtained as a cumulative number average particle size D50p.

The shape factor SF1 of the toner according to this exemplary embodiment is preferably in the range of from 115 to 140.

From the viewpoint of developability and transferability, it is desirable that the toner particle shape is a spherical shape. However, cleanability deteriorates in comparison to the case of an indeterminate shape. When the toner has a shape factor in the above range, transfer efficiency and image precision are improved and a high-quality image is formed. In addition, the cleanability of the surface of a photoreceptor increases.

The shape factor SF1 is preferably in the range of from 120 to 138.

Here, the shape factor SF1 is obtained by the following Formula (1)

$$SF1=(ML^2/A)\times(\pi/4)\times 100 \qquad \text{Formula (1)}$$

In the Formula (1), ML represents an absolute maximum length of the toner particle, and A represents a projected area of the toner particle.

SF1 may be calculated as follows mainly using a microscopic image or an image of a scanning electron microscope (SEM) image that is analyzed using an image analyzer to be digitalized. That is, an optical microscopic image of particles sprayed on the surface of a glass slide is scanned to an image analyzer LUZEX through a video camera, the maximum lengths and the projected areas of 100 particles are obtained for calculation using the above-described Formula (1), and an average value thereof is obtained.

<Toner Manufacturing Method>

A toner manufacturing method according to this exemplary embodiment is not particularly limited. The toner is prepared by a dry method such as a known kneading pulverization method or a wet method such as an emulsion aggregation method or a suspension polymerization method. Among the methods, an emulsion aggregation method for easily preparing a toner having a core-shell structure is preferably used. Hereinafter, a toner manufacturing method according to this exemplary embodiment using an emulsion aggregation method will be described in detail.

In the emulsion aggregation method, a dispersion (resin particle dispersion) in which toner constituent materials are dispersed in an aqueous dispersion is provided (emulsification process). Next, the resin particle dispersion and various dispersions (colorant dispersion, release agent dispersion and the like) that are used as necessary are mixed to provide a raw material dispersion.

Next, in the raw material dispersion, toner particles are obtained through an aggregated particle forming process of forming aggregated particles and a coalescence process of coalescing the aggregated particles. In the preparation of a toner with a so-called core-shell structure that has a core particle and a shell layer coating the core particle, a resin particle dispersion (to be a core particle when the toner is prepared) is added to the raw material dispersion after the aggregated particle forming process to adhere resin particles (to be a shell layer when the toner is prepared) to the surfaces of aggregated particles to thereby perform a coating layer forming process of forming a coating layer. Then, a coalescence process is performed. The resin component that is used in the coating layer forming process may be the same as or different from a resin component constituting a core particle.

Hereinafter, the processes will be described in detail.

—Emulsification Process—

In order to provide a raw material dispersion that is used in the aggregated particle forming process, an emulsion dispersion in which a major material constituting a toner is dispersed in an aqueous medium is prepared in the emulsification process. Hereinafter, a resin particle dispersion, a colorant dispersion, and a release agent dispersion will be described.

—Resin Particle Dispersion—

The volume average particle size of resin particles that are dispersed in a resin particle dispersion may be from 0.01 μm to 1 μm, from 0.03 μm to 0.8 μm, or from 0.03 μm to 0.6 μm.

When the volume average particle size of resin particles is greater than 1 μm, the particle size distribution of a finally obtained toner is broadened or free particles are generated, whereby performance and reliability may easily deteriorate. It is desirable that the volume average particle size is in the above range from the viewpoint that the above-described faults do not occur, uneven composition distribution between toner particles is reduced, the dispersion in the toner is good, and a variation in performance and reliability is small.

The volume average particle size of particles such as resin particles that are included in the raw material dispersion is measured by a laser diffraction particle size distribution measuring apparatus (manufactured by Horiba, Ltd., LA-700).

The dispersion medium that is used for the resin particle dispersion and other dispersions may be an aqueous medium.

Examples of the aqueous medium include water such as distilled water and ion exchange water, alcohols and the like. These may be used singly or in combination of two or more kinds. In the invention, a surfactant may be added and mixed into the aqueous medium.

The surfactant is not particularly limited, and examples thereof include anionic surfactants such as sulfate-based, sulfonate-based, phosphate-based, and soap-based surfactants; cationic surfactants such as amine salt-based and quaternary ammonium salt-based surfactants; nonionic surfactants such as polyethylene glycol-based, alkylphenol ethylene oxide adduct-based, and polyhydric alcohol-based surfactants; and the like. Among them, anionic surfactants and cationic surfactants may be used. The nonionic surfactants may be used in combination with the anionic surfactants or cationic surfactants. The surfactants may be used singly or in combination of two or more kinds.

Specific examples of the anionic surfactants include sodium dodecylbenzene sulfonate, sodium dodecyl sulfate, sodium alkyl naphthalene sulfonate, dialkyl sodium sulfosuccinate, and the like. In addition, specific examples of the cationic surfactants include alkylbenzene dimethyl ammonium chloride, alkyl trimethyl ammonium chloride, distearyl ammonium chloride, and the like. Among them, ionic surfactants such as anionic surfactants and cationic surfactants may be used.

Since a polyester resin contains a functional group that may be an anionic type due to neutralization, the polyester resin has self-dispersibility in water, and forms a stabilized water dispersion under action of an aqueous medium, in which some or all of functional groups that may have hydrophilicity are neutralized by a base.

The functional group that may be a hydrophilic group by neutralization in the polyester resin is an acid group such as a carboxyl group or a sulfonate group. Therefore, examples of a neutralizer include inorganic alkalis such as potassium hydroxide and sodium hydroxide, amines such as ammonia, monomethylamine, dimethylamine, trimethylamine, monoethylamine diethylamine, triethylamine, mono-n-propylamine, dimethyl-n-propylamine, monoethanolamine, diethanolamine, triethanolamine, N-methylethanolamine, N-aminoethylethanolamine, N-methyldiethanolamine, monoisopropanolamine, diisopropanolamine, triisopropanolamine, N,N-dimethylpropanolamine, and the like. At least one of them may be selected and used. The pH in emulsification is adjusted to be neutral by adding the neutralizers, thereby preventing hydrolysis of the obtained polyester resin dispersion.

When the resin particle dispersion is prepared using a polyester resin, a phase inversion emulsification method may be used. The phase inversion emulsification method may be used also when the resin particle dispersion is prepared using a binder resin other than a polyester resin. In the phase inversion emulsification method, a resin to be dispersed is dissolved in a hydrophobic organic solvent in which the resin is soluble, and a base is added to an organic continuous phase (O-phase) to neutralize. Then, an aqueous medium (W-phase) is added, and thus conversion (so-called phase inversion) of the resin from W/O to O/W occurs to form a discontinuous phase, whereby the resin is stably dispersed in the aqueous medium in a particulate form.

Examples of the organic solvent that is used in the phase inversion emulsification include alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol and cyclohexanol, ketones such as methyl ethyl ketone, methyl isobutyl ketone, ethyl butyl ketone, cyclohexanone and isophorone, ethers such as tetrahydrofuran, dimethyl ether, diethyl ether and dioxane, esters such as methyl acetate, ethyl acetate, n-propyl acetate, isopropyl acetate, n-butyl acetate, isobutyl acetate, sec-butyl acetate, 3-methoxybutyl acetate, methyl propionate, ethyl propionate, butyl propionate, dimethyl oxalate, diethyl oxalate, dimethyl succinate, diethyl succinate, diethyl carbonate and dimethyl carbonate, glycol derivatives such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate and dipropylene glycol monobutyl ether, 3-methoxy-3-methylbutanol, 3-methoxybutanol, acetonitrile, dimethyl formamide, dimethyl acetamide, diacetone alcohol, ethyl acetoacetate, and the like. These solvents may be used singly or in combination of two or more kinds.

Regarding the amount of an organic solvent that is used in the phase inversion emulsification, the amount of a solvent for obtaining a desired dispersed particle size varies with the physical properties of the resin, and thus in general, it is difficult to determine the amount of a solvent. However, in the present exemplary embodiment, when the content of a tin compound catalyst in the resin is relatively large as compared with that in common polyester resins, the amount of the solvent with respect to the weight of the resin may be relatively large. When the amount of the solvent is small, the emulsifying property becomes insufficient, and thus the particle diameter of resin particles may increase or the particle size distribution may broaden.

Furthermore, a dispersant may be added for the purpose of stabilizing dispersed particles or preventing an increase in viscosity of an aqueous medium in the phase inversion emulsification. Examples of the dispersant include water-soluble polymers such as polyvinyl alcohol, methyl cellulose, ethyl cellulose, hydroxyethyl cellulose, carboxymethyl cellulose, sodium polyacrylate and sodium polymethacrylate, surfactants such as anionic surfactants such as sodium dodecylbenzene sulfonate, sodium octadecyl sulfate, sodium oleate, sodium laurate and potassium stearate, cationic surfactants such as laurylamine acetate, stearylamine acetate and lauryl trimethyl ammonium chloride, zwitterionic surfactants such as lauryl dimethylamine oxide, and nonionic surfactants such as polyoxyethylene alkyl ether, polyoxyethylene alkyl phenyl ether and polyoxyethylene alkylamine, inorganic compounds such as tricalcium phosphate, aluminum hydroxide, calcium sulfate, calcium carbonate and barium carbonate, and the like. These dispersants may be used singly or in combination of two or more kinds. The dispersant may be added in an amount of from 0.01 part by weight to 20 parts by weight with respect to 100 parts by weight of the binder resin.

The emulsification temperature in the phase inversion emulsification may be equal to or lower than the boiling point of the organic solvent, and equal to or higher than the melting temperature or the glass transition temperature of the binder resin. When the emulsification temperature is lower than the melting temperature or the glass transition temperature of the binder resin, it is difficult to prepare a resin particle dispersion. When the emulsification is performed at a temperature equal to or higher than the boiling point of the organic solvent, the emulsification may be performed in a pressurized and sealed device.

Generally, the content of resin particles that are contained in the resin particle dispersion may be from 5% by weight to 50% by weight, and more preferably from 10% by weight to 40% by weight. When the content is outside the above range, the particle size distribution of resin particles may be broadened or the characteristics may deteriorate.

—Colorant Dispersion—

Examples of a dispersing method to prepare a colorant dispersion include, but are not limited thereto, a general dispersing method using a rotation shearing homogenizer, a ball mill having a media, a sand mill or a DYNO mill. If necessary, an aqueous dispersion of a colorant may be prepared by using a surfactant, or an organic solvent dispersion of a colorant may be prepared by using a dispersant. The surfactant or the dispersant that is used in the dispersion may be the same as a dispersant that may be used in the dispersion of the binder resin.

In addition, in the preparation of the raw material dispersion, the colorant dispersion may be mixed together with a dispersion in which other particles are dispersed at one time, or may be added and mixed in divided multiple stages.

Generally, the content of the colorant that is contained in the colorant dispersion may be from 5% by weight to 50% by weight, or from 10% by weight to 40% by weight. When the content is outside the above range, the particle size distribution of colorant particles may be broadened or the characteristics may deteriorate.

—Release Agent Dispersion—

A release agent dispersion is prepared through processes of dispersing a release agent in water together with an ionic surfactant or the like, heating to a temperature equal to or higher than a melting temperature of the release agent, and applying a strong shearing force by using a homogenizer or a pressure discharging dispersing machine. In this manner, release agent particles having a volume average particle size of 1 μm or less are dispersed. In addition, the dispersion medium in the release agent dispersion may be the same as that which is used for the binder resin.

A known device may be used as a device for mixing, and emulsifying and dispersing the binder resin, a colorant or the like with a dispersion medium, and examples thereof include continuous emulsification-dispersing machines such as Homo Mixer (Primix Corporation), Slasher (Nippon Coke & Engineering Co., Ltd.), Cavitron (Eurotec Ltd.), Microfluidizer (Mizuho Industrial Co., Ltd.), Manton-Gaulin homogenizer (Manton Gaulin Mfg. Co., Inc.), Nanomizer (Nanomizer Inc.), and Static Mixer (Noritake CO., Ltd).

Depending on the purpose, the above-described components such as the release agent, the internal additive, the charge-controlling agent or the inorganic powder may be added to the binder resin dispersion liquid.

In addition, when a dispersion of a component other than the binder resin, the colorant and the release agent is prepared, the volume average particle diameter of particles to be dispersed in the dispersion may be generally 1 μm or less, or from 0.01 μm to 0.5 μm. When the volume average particle size is greater than 1 μm, the particle size distribution of a finally obtained toner is broadened or free particles are generated, whereby performance and reliability may easily deteriorate. It is desirable that the volume average particle size is in the above range from the viewpoint that the above-described faults do not occur, uneven distribution between toner particles is reduced, the dispersion in the toner is good, and a variation in performance and reliability is small.

—Aggregated Particle Forming Process—

In the aggregated particle forming process, an aggregating agent is further added to the raw material dispersion that is generally obtained by adding the resin particle dispersion liquid as well as the colorant dispersion and the release agent dispersion and mixing other dispersions that are added as necessary. Subsequently, the mixture is heated, thereby aggregating the particles to form aggregated particles. When the resin particle is a crystalline resin such as crystalline polyester, the heating is performed at a temperature that is near a melting temperature (±20° C.) of the crystalline resin and is equal to or lower than the melting temperature, thereby aggregating the particles to form aggregated particles.

In the formation of aggregated particles, a photopolymerization initiator may be added to the raw material dispersion.

The aggregated particles are formed, for example, by adding an aggregating agent during the stirring by a rotation shearing homogenizer at room temperature, and making the pH of the raw material dispersion acidic. In order to suppress abrupt aggregation due to the heating, the pH may be adjusted during the stirring and mixing at room temperature, and if necessary, a dispersion stabilizer may be added.

In this exemplary embodiment, "room temperature" means 25° C.

Examples of the aggregating agent that is used in the aggregated particle forming process include a surfactant having a polarity opposite to that of the surfactant used as a dispersant added to the raw material dispersion. That is, a divalent or higher-valent metal complex and inorganic metal salt may be used. Particularly, when a metal complex is used, the amount of the surfactant used may be reduced, and charging characteristics are improved.

If necessary, an additive that forms a complex or a similar bond with the metal ions in the aggregating agent may be used. A chelating agent may be used as the additive.

Here, examples of the inorganic metal salt include metal salts such as calcium chloride, calcium nitrate, barium chloride, magnesium chloride, zinc chloride, aluminum chloride and aluminum sulfate; inorganic metal salt polymers such as polyaluminum chloride, polyaluminum hydroxide and calcium polysulfide. Among them, aluminum salt and polymer thereof may be used. In order to obtain a narrower particle size distribution, the valence of the inorganic metallic salt is preferably larger, i.e., divalent is better than monovalent, trivalent is better than divalent, and tetravalent is better than trivalent, and in the case of the same valence number, a polymer-type inorganic metallic salt polymer is more preferably used.

A water-soluble chelating agent may be used as the chelating agent. In the case of a water-insoluble chelating agent, the dispersibility in the raw material dispersion may be poor and the capture of metal ions resulting from the aggregating agent in the toner may be insufficient.

The chelating agent is not particularly limited if it is a known water-soluble chelating agent. Examples of the chelating agent include oxycarboxylic acids such as tartaric acid, citric acid and gluconic acid, iminodiacetic acid (IDA), nitrilotriacetic acid (NTA), ethylenediamine tetraacetic acid (EDTA), and the like.

The amount of the chelating agent added is preferably in the range of from 0.01 part by weight to 5.0 parts by weight with respect to 100 parts by weight of the binder resin, and more preferably in the range of from 0.1 part by weight to less than 3.0 parts by weight. When the amount of the chelating agent added is less than 0.01 part by weight, the effect of the addition of the chelating agent may not be expressed. On the other hand, when the amount of the chelating agent added is greater than 5.0 parts by weight, the electrostatic property is adversely affected and the viscoelasticity of the toner may dramatically change, whereby the low-temperature fixability and the image gloss property may be adversely affected.

The chelating agent may be added during, or before or after the aggregated particle forming process or the coating layer forming process. When the chelating agent is added, it is not required to control the temperature of the raw material dispersion. The chelating agent may be added at room temperature, or may be added after adjusting to the temperature in a tank in the aggregated particle forming process or the coating layer forming process.

—Coating Layer Forming Process—

After the aggregated particle forming process, the coating layer forming process may be performed, if necessary. In the coating layer forming process, resin particles for forming a coating layer are adhered to the surfaces of the aggregated particles formed through the above-described aggregated particle forming process, thereby forming the coating layer. In this manner, a toner having a so-called core-shell structure is obtained.

Generally, the coating layer is formed by additionally adding a resin particle dispersion to the raw material dispersion containing the aggregated particles (core particles) formed in the aggregated particle forming process.

A coalescence process is performed after the coating layer forming process. The coating layer may be formed in multiple stages by alternately repeating the coating layer forming process and the coalescence process.

—Coalescence Process—

In the coalescence process that is performed after the aggregated particle forming process, or after the aggregated particle forming process and the coating layer forming process, the progress of the aggregation is stopped by adjusting the pH of a suspension containing the aggregated particles formed through the above processes to the range of from about 6.5 to about 8.5.

After the progress of the aggregation is stopped, the aggregated particles are coalesced by heating. The aggregated particles may be coalesced by heating at a temperature equal to or higher than the melting temperature of the binder resin.

—Washing and Drying Processes and the Like—

After the aggregated particle coalescence process, a washing process, a solid liquid separation process and a drying process are performed to obtain desired toner particles. In the washing process, it is desirable that after the dispersant attached onto the toner particles is removed with a strong acid aqueous solution such as hydrochloric acid, sulfuric acid or nitric acid, the toner particles are washed with ion exchange water or the like until the pH of the filtrate is neutral. In addition, the solid-liquid separation process is not particularly limited, and suction filtration, pressure filtration, and the like may be used from the viewpoint of productivity. Furthermore, the drying process is not particularly limited, and spray drying, freeze drying, flush jet drying, fluidized drying, vibrating fluidized drying and the like are used from the viewpoint of productivity.

In the drying process, the water content of the toner particles after drying may be adjusted to 1.0% by weight or less, or to 0.5% by weight.

If necessary, the above-described various external additives may be added to the toner particles after drying.

<Electrostatic Charge Image Developer>

An electrostatic charge image developer (hereinafter, simply referred to as "developer" in some cases) according to this exemplary embodiment is not particularly limited if it contains the toner according to this exemplary embodiment. The developer may be a single-component developer or a two-component developer. When the developer is used as the two-component developer, the toner is used by mixing with a carrier.

The carrier that may be used in the two-component developer is not particularly limited and a known carrier is used. Examples thereof include magnetic metals such as iron oxide, nickel and cobalt, magnetic oxides such as ferrite and magnetite, resin-coated carriers having a resin coating layer on the surface of a core material, magnetic dispersed carriers, and the like. Examples of the carrier also include conductive particle dispersed coated carriers in which a conductive material or the like is dispersed in a coat resin.

Examples of the coating resin or the matrix resin that is used for the carrier include, but are not limited thereto, polyethylene, polypropylene, polystyrene, polyvinyl acetate, polyvinyl alcohol, polyvinyl butyral, polyvinyl chloride, polyvinyl ether, polyvinyl ketone, a copolymer of vinyl chloride-vinyl acetate, a copolymer of styrene-acrylate, a straight silicone resin formed of an organosiloxane bond or the modified products thereof, a fluorine resin, polyester, polycarbonate, a phenol resin, an epoxy resin, and the like.

Examples of the conductive material include, but are not limited thereto, metals such as gold, silver and copper, titanium oxide, zinc oxide, barium sulfate, aluminum borate, potassium titanate, tin oxide, carbon black, and the like.

Examples of the core material of the carrier include magnetic metals such as iron, nickel and cobalt, magnetic oxides such as ferrite and magnetite, glass beads, and the like. The core material of the carrier may be a magnetic material when the carrier is used in a magnetic brush method.

The volume average particle size of the core material of the carrier is generally from 10 μm to 500 μl, and may be from 30 μm to 100 μm.

Examples of the method of coating the surface of the core material of the carrier with a resin include a coating method with a coating layer forming solution that is obtained by dissolving the above-described coating resin, and if necessary, various additives in an appropriate solvent. The solvent is not particularly limited, and may be selected in consideration of the coating resin to be used, the coating suitability and the like.

Specific examples of the resin coating method include a dipping method that includes dipping the core material of a carrier in a coating layer forming solution, a spray method that includes spraying a coating layer forming solution onto the surface of the core material of a carrier, a fluidized-bed method that includes spraying a coating layer forming solution in a state in which the core material of a carrier is floated by fluidizing air, and a kneader coater method that includes mixing the core material of a carrier and a coating layer forming solution in a kneader coater and removing a solvent.

The mixing ratio (weight ratio) of the toner to the carrier in the two-component developer may be in the range of from about 1:100 to about 30:100 (toner:carrier), or may be in the range of from about 3:100 to about 20:100.

<Image Forming Apparatus, Image Forming Method>

Next, an image forming apparatus and an image forming method according to this exemplary embodiment using the electrostatic charge image developing toner according to this exemplary embodiment will be described.

The image forming apparatus according to this exemplary embodiment includes a photoreceptor, a charging unit that charges the photoreceptor, an electrostatic charge image forming unit that forms an electrostatic charge image on the charged photoreceptor, a developing unit that develops the electrostatic charge image formed on the photoreceptor as a toner image by using the developer according to this exemplary embodiment, a transfer unit that transfers the toner image onto a transfer medium, a fixing unit that fixes the toner image transferred onto the transfer medium on the transfer medium, and a light irradiation unit that irradiates the toner image fixed on the transfer medium with light.

In the image forming apparatus, for example, a portion including the developing unit may have a cartridge structure (process cartridge) that is detachably mounted on the main body of the image forming apparatus. As the process cartridge, a process cartridge according to this exemplary embodiment provided with at least a developer holding member accommodating the developer according to this exemplary embodiment may be used.

Hereinafter, an example of the image forming apparatus according to this exemplary embodiment will be described. However, the invention is not limited thereto. Only the major parts shown in the drawing will be described, and the descriptions of other parts will be omitted.

FIG. 1 is a diagram illustrating the schematic configuration of a four-drum tandem-type color image forming apparatus. The image forming apparatus shown in FIG. 1 is provided with first to fourth electrophotographic image forming units 10Y, 10M, 10C, and 10K (image forming units) that output images of the respective colors of yellow (Y), magenta (M), cyan (C), and black (K) based on color-separated image data. The image forming units (hereinafter, simply referred to as "unit" in some cases) 10Y, 10M, 10C, and 10K are arranged in a horizontal direction at predetermined intervals. The units 10Y, 10M, 10C, and 10K each may be a process cartridge that is detachably mounted on the main body of the image forming apparatus.

An intermediate transfer belt 20 as an intermediate transfer medium is disposed above the units 10Y, 10M, 10C, and 10K in the drawing to extend via the units. The intermediate transfer belt 20 is wound on a driving roller 22 and a support roller 24 coming into contact with the inner surface of the intermediate transfer belt 20, which are separated from each other on the left and right sides in the drawing, and travels in the direction toward the fourth unit 10K from the first unit 10Y. The support roller 24 receives a force by a spring or the like (not shown) in the direction in which it departs from the driving roller 22, and thus a tension is given to the intermediate transfer belt 20 wound on both of the rollers. In addition, an intermediate transfer medium cleaning device 30 opposed to the driving roller 22 is provided in a surface of the intermediate transfer belt 20 on the image holding member side.

In addition, developing devices (developing units) 4Y, 4M, 4C and 4K of the units 10Y, 10M, 100 and 10K are supplied with four color toners of yellow, magenta, cyan, and black accommodated in toner cartridges 8Y, 8M, 8C and 8K, respectively.

The above-described first to fourth units 10Y, 10M, 10C, and 10K have the same configuration, and thus only the first unit 10Y that is used for forming a yellow image and is disposed on the upstream side in the traveling direction of the intermediate transfer belt will be representatively described. The same portions as in the first unit 10Y will be denoted by the reference numerals having magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roller 2Y that charges a surface of the photoreceptor 1Y to a predetermined potential, an exposure device (electrostatic charge image forming unit) 3 that exposes the charged surface with a laser beam 3Y based on a color-separated image signal to form an electrostatic charge image, a developing device (developing unit) 4Y that supplies a charged toner to the electrostatic charge image to develop the electrostatic charge image, a primary transfer roller (primary transfer unit) 5Y that transfers the developed toner image onto the intermediate transfer belt 20, and a photoreceptor cleaning device (cleaning unit) 6Y that removes the toner remaining on the surface of the photoreceptor 1Y after primary transfer, are arranged in sequence.

The primary transfer roller 5Y is disposed inside the intermediate transfer belt 20 and is provided at a position opposed to the photoreceptor 1Y. Bias supplies (not shown) that apply a primary transfer bias are connected to the primary transfer rollers 5Y, 5M, 5C, and 5K, respectively. The bias supplies change the transfer bias that is applied to the respective primary transfer rollers under the control of a controller (not shown).

Hereinafter, the operation of forming a yellow image in the first unit 10Y will be described. First, before the operation, the surface of the photoreceptor 1Y is charged to a potential of from about −600 V to about −800 V by the charging roller 2Y.

The photoreceptor 1Y is formed by stacking a photosensitive layer on a conductive base (volume resistivity at 20° C.: $1\times10^{-6}$ Ωcm or less). Generally, this photosensitive layer has high resistance (resistance corresponding to the resistance of a general resin), but has a property that, when the laser beam 3Y is applied thereto, the specific resistance of a portion irradiated with the laser beam changes. Accordingly, the laser beam 3Y is output to the surface of the charged photoreceptor 1Y via the exposure device 3 in accordance with image data for yellow sent from the controller (not shown). The laser beam 3Y is applied to the photosensitive layer on the surface of the photoreceptor 1Y, whereby an electrostatic charge image of a yellow print pattern is formed on the photoreceptor 1Y.

The electrostatic charge image is an image that is formed on the photoreceptor 1Y by the charging, and is a so-called negative latent image, that is formed by applying the laser beam 3Y to the photosensitive layer so that the specific resistance of the irradiated portion is lowered to cause charges to flow on the surface of the photoreceptor 1Y and cause charges to stay in a portion to which the laser beam 3Y is not applied.

The electrostatic charge image that is formed on the photoreceptor 1Y in this manner is rotated up to a predetermined developing position with the travelling of the photoreceptor 1Y. The electrostatic charge image on the photoreceptor 1Y is visualized (to form a developed image) at the developing position by the developing device 4Y.

In the developing device 4Y, an electrostatic charge image developer containing at least a yellow toner and a carrier is accommodated. The yellow toner is stirred in the developing device 4Y to be frictionally charged, and is held on a developer roll (developer holding member) with a charge having the same polarity (negative) as the charge on the photoreceptor 1Y. When the surface of the photoreceptor 1Y passes through the developing device 4Y, the yellow toner is electrostatically adhered to an erased latent image portion on the surface of the photoreceptor 1Y, and the latent image is developed by the yellow toner.

A bias potential (developing bias) generated by superimposing an AC component on a DC component may be applied to the developer holding member from the viewpoint of development efficiency, image graininess, tone reproducibility and the like. More specifically, when a DC voltage Vdc applied to the developer holding member is from −300 V to −700 V, a width Vp-p of a peak of an AC voltage on the developer holding member may be in the range of from 0.5 to 2.0 kV.

The photoreceptor 1Y on which the yellow toner image is formed travels at a predetermined speed, and then the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y, and an electrostatic force from the photoreceptor 1Y toward the primary transfer roller 5Y acts on the toner image, whereby the toner image on the photoreceptor 1Y is transferred onto the intermediate transfer belt 20. At this time, the applied transfer bias has a positive (+) polarity opposite to the polarity (−) of the toner. For example, the transfer bias of the first unit 10Y is controlled to about +10 μA by the controller (not shown).

Meanwhile, the toner that remains on the photoreceptor 1Y is removed by the cleaning device 6Y to be collected.

The primary transfer bias that is applied to the primary transfer rollers 5M, 5C, and 5K of the second units 10M, 10C, and 10K is controlled in the same manner as in the first unit.

In this manner, the intermediate transfer belt 20 onto which the yellow toner image is transferred by the first unit 10Y is sequentially transported through the second to fourth units 10M, 10C, and 10K, and the toner images of respective colors are superimposed and multiply-transferred.

The intermediate transfer belt 20 onto which the toner images of four colors are multiply-transferred through the first to fourth units reaches a secondary transfer portion that is constituted by the intermediate transfer belt 20, the support roller 24 that contacts with the inner surface of the intermediate transfer belt, and a secondary transfer roller (secondary transfer unit) 26 that is disposed on the image supporting surface side of the intermediate transfer belt 20. A recording sheet (transfer medium) P is supplied to a gap between the secondary transfer roller 26 and the intermediate transfer belt 20, which are pressed against each other, via a supply mechanism at a predetermined timing, and a secondary transfer bias is applied to the support roller 24. At this time, the applied transfer bias has the same polarity (−) as the polarity (−) of the toner. An electrostatic force from the intermediate transfer belt 20 toward the recording sheet P acts on the toner image, and the toner image on the intermediate transfer belt 20 is transferred onto the recording sheet P. The secondary transfer bias is determined depending on the resistance detected by a resistance detector (not shown) that detects the resistance of the secondary transfer portion, and is voltage-controlled.

Thereafter, the recording sheet P is fed to a pressure-contact portion (nip portion) of a pair of fixing rolls of the fixing device (fixing unit) 28, the toner image is heated, and the color-superimposed toner image is fused and fixed on the recording sheet P.

Next, the toner image fixed on the recording sheet P is irradiated with light from a light irradiation unit 32. Accordingly, the unsaturated bond that is included in the particular polyester resin constituting the toner image causes a polymerization reaction by the action of the photopolymerization initiator, and the particular polyester resin is cured. In order to promote the polymerization reaction, it is desirable that the viscosity of the toner image when the toner image is irradiated with light is low. Accordingly, it is desirable that the toner image is rapidly irradiated with light from the light irradiation unit 32 after fixing by the fixing device 28.

The wavelength of the light that is applied by the light irradiation unit 32 is selected to allow the photopolymerization initiator contained in the toner to cause the polymerization reaction, and for example, is from 280 nm to 440 nm.

In addition, the light irradiation unit 32 is not particularly limited if it may apply light having a wavelength capable of causing the polymerization reaction by the photopolymerization initiator, and examples thereof include a metal halide lamp (wavelength range: 200 nm to 600 nm). In the case of LED-UV, the selected wavelength is any one of 365/375/385 nm.

Examples of the transfer medium onto which the toner image is transferred include plain paper, OHP sheet and the like that are used in electrophotographic copiers, printers and the like.

The recording sheet P on which color image fixing is completed is sent toward a discharge portion, and a series of the color image forming operations ends.

The above-described image forming apparatus has a configuration in which the toner image is transferred onto the recording sheet P via the intermediate transfer belt 20, but is not limited thereto. The toner image may be directly transferred from the photoreceptor to the recording sheet.

The image forming method according to this exemplary embodiment includes a charging process of charging a surface of an image holding member; a latent image forming process of forming an electrostatic latent image on the surface of the image holding member; a developing process of developing the electrostatic latent image formed on the surface of the image holding member as a toner image by using the developer according to this exemplary embodiment; a transfer process of transferring the developed toner image onto a transfer medium; a fixing process of fixing the toner image transferred onto the transfer medium on the transfer medium; and a light irradiation process of irradiating the toner image fixed on the transfer medium with light.

<Process Cartridge and Toner Cartridge>

Next, a process cartridge according to this exemplary embodiment will be described. The process cartridge according to this exemplary embodiment includes a developer holding member and the developer according to this exemplary embodiment.

Figure 2:
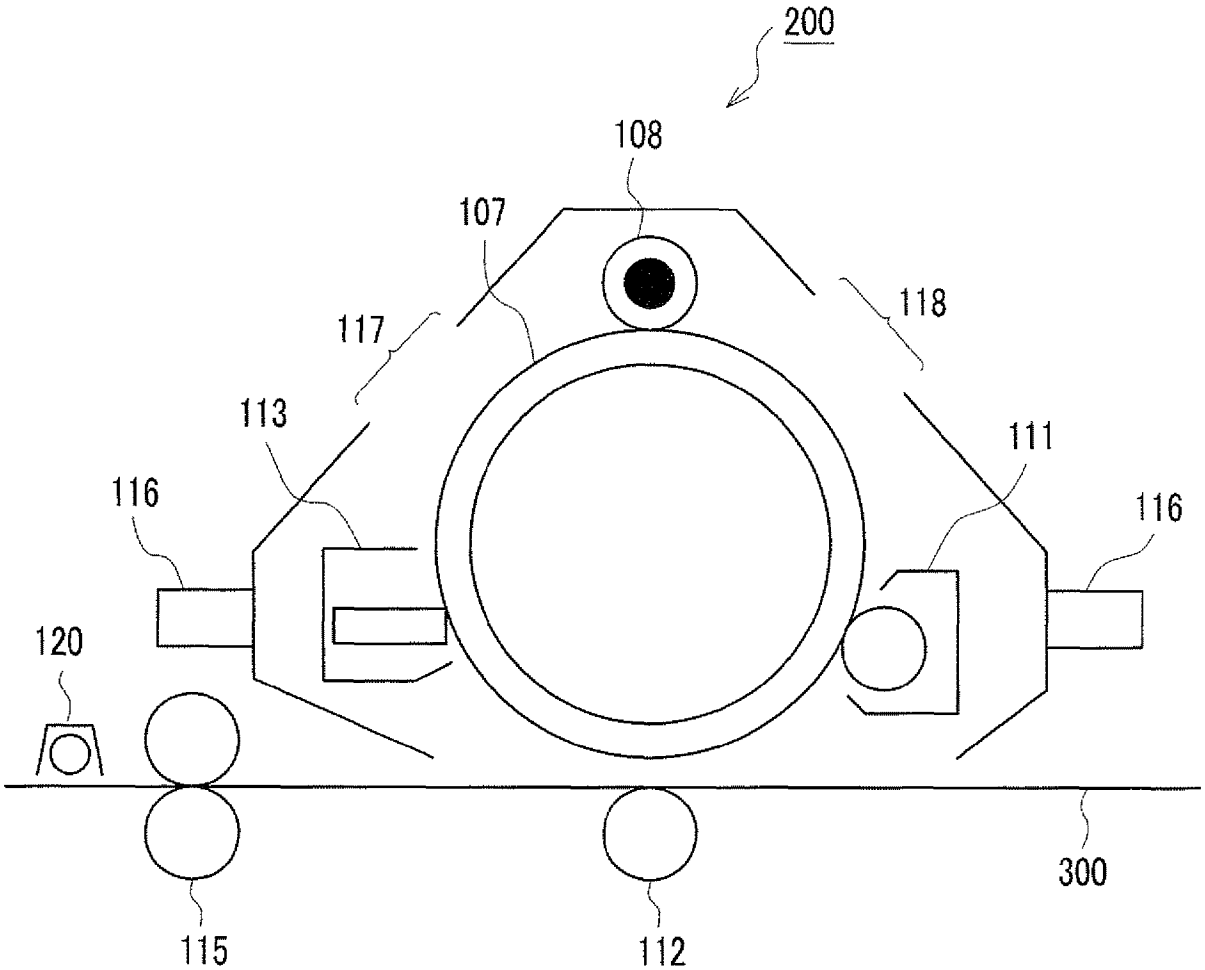
FIG. 2 is a diagram showing the schematic configuration of an example of a process cartridge according to the exemplary embodiment.

FIG. 2 is a diagram showing the schematic configuration of a desirable example of a process cartridge that accommodates the electrostatic charge image developer according to this exemplary embodiment. A process cartridge 200 has, in addition to a developing device 111, a photoreceptor 107, a charging roller 108, a photoreceptor cleaning device 113, an opening portion 118 for exposure, and an opening portion 117 for erasing exposure, that are combined and integrated using an attachment rail 116. The reference number 300 in FIG. 2 represents a transfer medium.

The process cartridge 200 is detachably mounted on the main body of an image forming apparatus including a transfer device 112, a fixing device 115, a light irradiation unit 120 and other constituent portions (not shown), and constitutes the image forming apparatus together with the main body of the image forming apparatus.

The process cartridge 200 shown in FIG. 2 is provided with the photoreceptor 107, the charging device 108, the developing device 111, the cleaning device 113, the opening portion 118 for exposure, and the opening portion 117 for erasing exposure, but these devices may be selectively combined. The process cartridge according to this exemplary embodiment may include at least one selected from the group consisting of the photoreceptor 107, the charging device 108, the cleaning device (cleaning unit) 113, the opening portion 118 for exposure, and the opening portion 117 for erasing exposure, as well as the developing device 111.

Next, a toner cartridge according to this exemplary embodiment will be described. The toner cartridge according to this exemplary embodiment is detachably mounted on an image forming apparatus, and at least, in the toner cartridge that accommodates a toner to be supplied to a developing unit provided in the image forming apparatus, the toner is the above-described electrostatic charge image developing toner according to this exemplary embodiment. In the toner cartridge according to this exemplary embodiment, at least a toner may be accommodated, and depending on the mechanism of the image forming apparatus, for example, a developer may be accommodated.

Accordingly, in an image forming apparatus having a configuration in which a toner cartridge is detachably mounted, when a toner cartridge storing the electrostatic charge image developing toner according to this exemplary embodiment is used, the electrostatic charge image developing toner according to this exemplary embodiment is easily supplied to a developing device.

The image forming apparatus shown in FIG. 1 is an image forming apparatus that has a configuration in which the toner cartridges 8Y, 8M, 8C, and 8K are detachably mounted. The developing devices 4Y, 4M, 4C, and 4K are connected to the toner cartridges corresponding to the respective developing devices (colors) via toner supply tubes (not shown). In addition, when the toner stored in a toner cartridge runs low, the toner cartridge is replaced.

EXAMPLES

Hereinafter, this exemplary embodiment will be described in more detail using examples and comparative examples, but is not limited to the following examples. "%" is based on the mass and "parts" represents "parts by weight" unless specifically noted.

(Synthesis of Polyester Resin 1)

2260 parts of terephthalic acid, 428 parts of dodecenylsuccinic acid, 3950 parts of a bisphenol A-propylene oxide adduct, 1580 parts of a bisphenol A-ethylene oxide adduct, and an esterified catalyst are reacted for 12 hours at 230° C. and at 101.3 kPa, and are further reacted for 0.5 hour at 10 kPa. Then, the reaction product is cooled to 190° C. and 185 parts of fumaric acid are added thereto. The temperature is raised to 210° C. over 3 hours, and then the materials are reacted up to a desired softening point at 7.5 kPa to obtain a polyester resin 1.

(Synthesis of Polyester Resin 2)

A polyester resin 2 is obtained in the same manner, except that 1860 parts of terephthalic acid and 1070 parts of dodecenylsuccinic acid are used in the synthesis of the polyester resin 1.

(Synthesis of Polyester Resin 3)

A polyester resin 3 is obtained in the same manner, except that 1460 parts of terephthalic acid and 1710 parts of dodecenylsuccinic acid are used in the synthesis of the polyester resin 1.

(Synthesis of Polyester Resin 4)

A polyester resin 4 is obtained in the same manner, except that 1460 parts of terephthalic acid and 740 parts of fumaric acid are used in the synthesis of the polyester resin 1.

(Synthesis of Polyester Resin 5)

A polyester resin 5 is obtained in the same manner, except that 1460 parts of terephthalic acid, 460 parts of fumaric acid and 1070 parts of dodecenylsuccinic acid are used in the synthesis of the polyester resin 1.

(Synthesis of Polyester Resin 6)

A polyester resin 6 is obtained in the same manner, except that 2520 parts of terephthalic acid and 185 parts of fumaric acid are used without using dodecenylsuccinic acid in the synthesis of the polyester resin 1.

(Synthesis of Polyester Resin 7)

A polyester resin 7 is obtained in the same manner, except that 2120 parts of terephthalic acid and 860 parts of dodecenylsuccinic acid are used without using fumaric acid in the synthesis of the polyester resin 1.

(Synthesis of Polyester Resin 8)

A polyester resin 8 is obtained in the same manner, except that 2790 parts of terephthalic acid are used without using fumaric acid and dodecenylsuccinic acid in the synthesis of the polyester resin 1.

(Preparation of Polyester Resin Dispersion 1)

350 parts of a polyester resin 1, 175 parts of methyl ethyl ketone, 61.8 parts of isopropyl alcohol and 12.3 parts of a 10% ammonia aqueous solution are put, mixed, and dissolved in a separable flask, and then ion exchange water is dropped at a liquid supply rate of 8 parts/min by using a liquid supply pump while the heating and the stirring are performed at 40° C. The liquid is uniformly suspended, and then the liquid supply rate is raised to 12 parts/min for phase inversion. The dropping is stopped when the liquid supply amount is 1050 parts. Thereafter, the solvent is removed under reduced pressure to obtain a polyester resin dispersion 1. The volume average particle size of the obtained polyester resin particles is 166 nm, and the solid content concentration of the resin particles is 41.7%.

(Preparation of Polyester Resin Dispersions 2 to 8)

Polyester resin dispersions 2 to 8 are prepared in the same manner as that in "Preparation of Polyester Resin Dispersion 1", except that the polyester resin 1 is changed to the polyester resins 2 to 8, respectively.

In terms of the volume average particle size of the obtained polyester resin particles, the polyester resin dispersion 2 has a volume average particle size of 171 nm, the polyester resin dispersion 3 has a volume average particle size of 169 nm, the polyester resin dispersion 4 has a volume average particle size of 165 nm, the polyester resin dispersion 5 has a volume average particle size of 169 nm, the polyester resin dispersion 6 has a volume average particle size of 158 nm, the polyester resin dispersion 7 has a volume average particle size of 166 nm, and the polyester resin dispersion 8 has a volume average particle size of 165 nm. In addition, in terms of the solid content concentration of the resin particles, the polyester resin dispersion 2 has a solid content concentration of 41.8%, the polyester resin dispersion 3 has a solid content concentration of 41.1%, the polyester resin dispersion 4 has a solid content concentration of 40.8%, the polyester resin dispersion 5 has a solid content concentration of 41.2%, the polyester resin dispersion 6 has a solid content concentration of 41.0%, the polyester resin dispersion 7 has a solid content concentration of 42.0%, and the polyester resin dispersion 8 has a solid content concentration of 41.5%

(Preparation of Release Agent Dispersion)

Unicid 350 (manufactured by TOYO ADL CORPORATION): 50 parts

Anionic Surfactant (manufactured by DAI-ICHI KOGYO SEIYAKU CO., LTD., Neogen RK): 5 parts Ion Exchange Water: 170 parts The above materials are heated to 110° C. to be dispersed using a homogenizer (manufactured by IKA Works GmbH & Co. KG: Ultra Turrax T50), and then subjected to a dispersion treatment by a Manton-Gaulin high-pressure homogenizer (manufactured by Manton Gaulin Mfg. Co., Inc.) to prepare a release agent dispersion (release agent concentration: 31%) in which the release agent is dispersed having an average particle size of 0.18 μm.

—Preparation of Colorant Dispersion—

Carbon Black #25 (manufactured by Mitsubishi Chemical Corporation): 100 parts

Anionic Surfactant (manufactured by DAI-ICHI KOGYO SEIYAKU CO., LTD.: Neogen RK): 15 parts Ion Exchange Water: 900 parts The above materials are mixed and dissolved, and dispersed for about 1 hour by using a high-pressure impact-type dispersing machine ULTIMIZER (manufactured by SUGINO MACHINE LIMITED, HJP 30006). Therefore, a colorant dispersion is obtained. The concentration of the colorant in the colorant dispersion is adjusted to 25%.

—Preparation of Toner 1—

Polyester Resin Dispersion 1: 320 parts

Colorant Dispersion: 60 parts

Anionic Surfactant (Dowfax 2A1 20% aqueous solution): 15 parts

Release Agent Dispersion: 80 parts

Irgacure-651 8 parts

Among the above-described raw materials, the polyester resin dispersion 1, the anionic surfactant, and 250 parts of ion exchange water are put in a polymerization vessel provided with a pH meter, a stirring blade and a thermometer, and a surfactant is made to equilibrate with the polyester resin dispersion while being stirred for 15 minutes at 130 rpm. To the obtained material, a colorant dispersion, a release agent dispersion, and Irgacure-651 (alkylphenone-based photopolymerization initiator, melting temperature: 67° C., solubility in water at 25° C.: 0.01%) are added and mixed, and then a 0.3 M nitric acid aqueous solution is added to the raw material mixture to adjust the pH to 4.8. While a shearing force is applied at 3000 rpm by an Ultra Turrax, 13 parts of a 10% nitric acid aqueous solution of aluminum sulfate are dropped as an aggregating agent. The viscosity of the raw material mixture increases during the dropping of the aggregating agent. Accordingly, by slowing down the dropping rate at the time when the viscosity increases, the aggregating agent is not concentrated at one place. When the dropping of the aggregating agent is ended, the rotation rate is further raised to 5000 rpm and stirring is performed for 5 minutes to sufficiently mix the aggregating agent and the raw material mixture.

Next, the raw material mixture is warmed to 25° C. by a mantle heater and stirred at 500 rpm. After stirring for 10 minutes, the formation of a primary particle size is confirmed by using a Coulter Multisizer II (aperture diameter: 50 μm; manufactured by Beckman Coulter, Inc.), and then the temperature is raised to 43° C. at 0.1° C./min in order to grow aggregated particles. The growth of aggregated particles is confirmed as necessary by using the Coulter Multisizer, and the aggregation temperature and the rotation rate of stirring are changed in accordance with the aggregation rate.

Meanwhile, for coating the aggregated particles, a resin particle dispersion for coating is prepared by adding and mixing 118 parts of ion exchange water and 8.2 parts of an anionic surfactant (Dowfax 2A1 20% aqueous solution) with respect to 180 parts of the polyester resin dispersion 1 and adjusting the pH in advance to 3.8. When the aggregated particles are grown to have a size of 5.2 μm in the aggregation process, the resin particle dispersion for coating prepared in advance is added and held for 20 minutes while being stirred. Thereafter, in order to stop the growth of the coated aggregated particles, 1.5 parts of EDTA are added, and then 1 M aqueous sodium hydroxide is added to control the pH of the raw material mixture to 7.6. In order to coalesce the aggregated particles together, the temperature is raised to 85° C. at a temperature increase rate of 1° C./min while the pH is adjusted to 7.6, and after the temperature reaches 85° C., the pH is adjusted to 7.6 or lower in order to allow the coalescence to progress. After confirmation of the coalescence of the aggregated particles by an optical microscope, ice water is injected for rapid cooling at a temperature decrease rate of 10° C./min in order to stop the growth of the particle size.

For the purpose of washing the obtained particles, the particles are sieved once with a 15 μm-mesh. Then, ion exchange water (30° C.) is added in an amount about 10 times the solid content and stirred for 20 minutes, and is then filtered. Furthermore, the solid content remaining on filter paper is dispersed in a slurry, repeatedly washed four times by ion exchange water of 30° C., and then dried to obtain toner particles 1 having a volume average particle size of 5.8 μm.

1.2 parts of a titania powder (manufactured by Soken Chemical % Engineering Co., Ltd.) are added with respect to 100 parts of the toner particles 1 prepared as described above to be externally added by a stirring mixer, thereby obtaining a toner 1.

The volume average particle size of the toner 1 is 5.8 μm

—Preparation of Toner 2—

A toner 2 having a volume average particle size of 5.8 μm is obtained in the same manner, except that the amount of Irgacure-651 added is 19 parts in the preparation of the toner 1.

—Preparation of Toner 3—

A toner 3 having a volume average particle size of 5.8 μm is obtained in the same manner, except that the amount of Irgacure-651 added is 32 parts in the preparation of the toner 1.

—Preparation of Toner 4—

A toner 4 having a volume average particle size of 5.8 μm is obtained in the same manner, except that the polyester resin dispersion 2 is used in place of the polyester resin dispersion 1 in the preparation of the toner 1.

—Preparation of Toner 5—

A toner 5 having a volume average particle size of 5.8 μm is obtained in the same manner, except that the amount of Irgacure-651 added is 19 parts in the preparation of the toner 4.

—Preparation of Toner 6—

A toner 6 having a volume average particle size of 5.8 μm is obtained in the same manner, except that the amount of Irgacure-651 added is 32 parts in the preparation of the toner 4.

—Preparation of Toner 7—

A toner 7 having a volume average particle size of 5.8 μm is obtained in the same manner, except that the polyester resin dispersion 3 is used in place of the polyester resin dispersion 1 in the preparation of the toner 1.

—Preparation of Toner 8—

A toner 8 having a volume average particle size of 5.8 μm is obtained in the same manner, except that the amount of Irgacure-651 added is 19 parts in the preparation of the toner 7.

—Preparation of Toner 9—

A toner 9 having a volume average particle size of 5.8 μm is obtained in the same manner, except that the amount of Irgacure-651 added is 32 parts in the preparation of the toner 7.

—Preparation of Toner 10—

A toner 10 having a volume average particle size of 5.8 μm is obtained in the same manner, except that the polyester resin dispersion 4 is used in place of the polyester resin dispersion 1 in the preparation of the toner 1.

—Preparation of Toner 11—

A toner 11 having a volume average particle size of 5.8 μm is obtained in the same manner, except that the amount of Irgacure-651 added is 19 parts in the preparation of the toner 10.

—Preparation of Toner 12—

A toner 12 having a volume average particle size of 5.8 μm is obtained in the same manner, except that the amount of Irgacure-651 added is 32 parts in the preparation of the toner 10.

—Preparation of Toner 13—

A toner 13 having a volume average particle size of 5.8 μm is obtained in the same manner, except that the polyester resin dispersion 5 is used in place of the polyester resin dispersion 1 in the preparation of the toner 1.

—Preparation of Toner 14—

A toner 14 having a volume average particle size of 5.8 μm is obtained in the same manner, except that the amount of Irgacure-651 added is 19 parts in the preparation of the toner 13.

—Preparation of Toner 15—

A toner 15 having a volume average particle size of 5.8 μm is obtained in the same manner, except that the amount of Irgacure-651 added is 32 parts in the preparation of the toner 13.

—Preparation of Toner 16—

A toner 16 having a volume average particle size of 5.8 μm is obtained in the same manner, except that 8 parts of Irgacure-819 (acylphosphine oxide-based photopolymerization initiator, melting temperature: 130° C., solubility in water at 25° C.: less than 0.01% by weight) are added in place of Irgacure-651 in the preparation of the toner 1.

—Preparation of Toner 17—

A toner 17 having a volume average particle size of 5.8 μm is obtained in the same manner, except that the amount of Irgacure-819 added is 19 parts in the preparation of the toner 16.

—Preparation of Toner 18—

A toner 18 having a volume average particle size of 5.8 μm is obtained in the same manner, except that the amount of Irgacure-819 added is 32 parts in the preparation of the toner 16.

—Preparation of Toner 19—

A toner 19 having a volume average particle size of 5.8 μm is obtained in the same manner, except that the polyester resin dispersion 2 is used in place of the polyester resin dispersion 1 in the preparation of the toner 16.

—Preparation of Toner 20—

A toner 20 having a volume average particle size of 5.8 μm is obtained in the same manner, except that the amount of Irgacure-819 added is 19 parts in the preparation of the toner 19.

—Preparation of Toner 21—

A toner 21 having a volume average particle size of 5.8 μm is obtained in the same manner, except that the amount of Irgacure-819 added is 32 parts in the preparation of the toner 19.

—Preparation of Toner 22—

A toner 22 having a volume average particle size of 5.8 μm is obtained in the same manner, except that the polyester resin dispersion 3 is used in place of the polyester resin dispersion 1 in the preparation of the toner 16.

—Preparation of Toner 23—

A toner 23 having a volume average particle size of 5.8 μm is obtained in the same manner, except that the amount of Irgacure-819 added is 19 parts in the preparation of the toner 22.

—Preparation of Toner 24—

A toner 24 having a volume average particle size of 5.8 μm is obtained in the same manner, except that the amount of Irgacure-819 added is 32 parts in the preparation of the toner 22.

—Preparation of Toner 25—

A toner 25 having a volume average particle size of 5.8 μm is obtained in the same manner, except that the polyester resin dispersion 4 is used in place of the polyester resin dispersion 1 in the preparation of the toner 16.

—Preparation of Toner 26—

A toner 26 having a volume average particle size of 5.8 μm is obtained in the same manner, except that the amount of Irgacure-819 added is 19 parts in the preparation of the toner 25.

—Preparation of Toner 27—

A toner 27 having a volume average particle size of 5.8 μm is obtained in the same manner, except that the amount of Irgacure-819 added is 32 parts in the preparation of the toner 25.

—Preparation of Toner 28—

A toner 28 having a volume average particle size of 5.8 μm is obtained in the same manner, except that the polyester resin dispersion 5 is used in place of the polyester resin dispersion 1 in the preparation of the toner 16.

—Preparation of Toner 29—

A toner 29 having a volume average particle size of 5.8 μm is obtained in the same manner, except that the amount of Irgacure-819 added is 19 parts in the preparation of the toner 28.

—Preparation of Toner 30—

A toner 30 having a volume average particle size of 5.8 μm is obtained in the same manner, except that the amount of Irgacure-819 added is 32 parts in the preparation of the toner 28.

—Preparation of Toner 31—

A toner 31 having a volume average particle size of 5.8 μm is obtained in the same manner, except that the polyester resin dispersion 6 is used in place of the polyester resin dispersion 1 in the preparation of the toner 1.

—Preparation of Toner 32—

A toner 32 having a volume average particle size of 5.8 μm is obtained in the same manner, except that the polyester resin dispersion 6 is used in place of the polyester resin dispersion 1 in the preparation of the toner 16.

—Preparation of Toner 33—

A toner 33 having a volume average particle size of 5.8 μm is obtained in the same manner, except that the polyester resin dispersion 7 is used in place of the polyester resin dispersion 1 in the preparation of the toner 1.

—Preparation of Toner 34—

A toner 34 having a volume average particle size of 5.8 μm is obtained in the same manner, except that the polyester resin dispersion 7 is used in place of the polyester resin dispersion 1 in the preparation of the toner 16.

—Preparation of Toner 35—

A toner 35 having a volume average particle size of 5.8 μm is obtained in the same manner, except that the polyester resin dispersion 8 is used in place of the polyester resin dispersion 1 in the preparation of the toner 1.

—Preparation of Toner 36—

A toner 36 having a volume average particle size of 5.8 μm is obtained in the same manner, except that the polyester resin dispersion 8 is used in place of the polyester resin dispersion 1 in the preparation of the toner 16.

—Preparation of Toner 37—

When a toner is prepared in the same manner, except that the amount of Irgacure-651 added is 44 parts in the preparation of the toner 1, the coalescence does not progress. Accordingly, the evaluation is not performed.

—Preparation of Toner 38—

A toner 38 having a volume average particle size of 5.9 μm is obtained in the same manner, except that the amount of Irgacure-651 added is 2 parts in the preparation of the toner 1.

—Preparation of Toner 39—

Polyester Resin 1: 208.5 parts

Carbon Black #25: 15 parts

Unicid 350 (manufactured by TOYO ADL CORPORATION): 24.8 parts

Irgacure-651: 21.6 parts

The above materials are mixed and put in an extruder-type kneader, the internal temperature is set to 120±5° C., and the kneading is performed at 120 rpm. Water is added to the mixture in advance so as not to excessively increase the inside temperature. The obtained kneaded material is cooled, and then coarsely pulverized by a hammer mill. The pulverized particles are finely pulverized to have a size of about 5.4 μm by using a jet mill, and then classified by an Elbow-Jet classifier (manufactured by Matsubo Corporation). An external additive is added in the same manner as that for the toner 1 and a toner 39 having a volume average particle size of 5.9 μm is obtained.

—Preparation of Toner 40—

A toner 40 having a volume average particle size of 5.9 μm is obtained in the same manner, except that Irgacure-651 is not added in the preparation of the toner 1.

Example 1

The toner 1 is weighed so that a toner concentration is 5% with respect to a ferrite carrier having a volume average particle size of 35 μm with a 1%-polymethylmethacrylate resin (Mw: 80000, manufactured by Ipros Corporation) coated thereon, and is stirred and mixed for 5 minutes by a ball mill to prepare a developer 1.

As an image forming apparatus, a color copier DocuCentre II-C3300 (manufactured by Fuji Xerox Co., Ltd.) modified so as to be able to irradiate the toner image after fixing with light having a dominant wavelength of 365 nm by using a metal halide 1000 W (Speed King I) (manufactured by Mario Network) as a light source is used.

Using the modified machine, an image is formed under the conditions of a toner application amount of 15.0 g/m$^2$ and a process speed of 250 mm/s. A scratch test using a steel wool is performed on the obtained toner image.

In the scratch test, a steel wool (Bonstar roll pad: manufactured by Nihon Steel Wool Co., Ltd.) is used and reciprocated 10 times on the surface of the toner image with a load of 250 g. The gloss before and after scratching by the steel wool is measured by a glossmeter (manufactured by BYK-Garder Gmbh, gloss measuring machine micro-TRI-gloss glossmeter). The gloss at an angle of 60° is used as an index. The difference in gloss before and after scratching by the steel wool is shown in Table 1.

Examples 2 to 32, Comparative Examples 1 to 8

The evaluation is performed in the same manner as that for Example 1, except that the toners 2 to 40 (except for the toner 37) are used in place of the toner 1. The obtained results are shown in Table 1.

TABLE 1

| | Toner | Proportion of Repeating Units Derived from Fumaric Acid | Proportion of Repeating Units Derived from Dodecenylsuccinic Acid | Photopolymerzation Initiator Kind | Photopolymerzation Initiator Amount | Difference in Gloss |
|---|---|---|---|---|---|---|
| Example 1 | Toner 1 | 10 mol % | 10 mol % | Irgacure-651 | 2% | 8 |
| Example 2 | Toner 2 | 10 mol % | 10 mol % | Irgacure-651 | 5% | 7 |
| Example 3 | Toner 3 | 10 mol % | 10 mol % | Irgacure-651 | 8% | 6 |
| Example 4 | Toner 4 | 10 mol % | 25 mol % | Irgacure-651 | 2% | 7 |
| Example 5 | Toner 5 | 10 mol % | 25 mol % | Irgacure-651 | 5% | 6 |
| Example 6 | Toner 6 | 10 mol % | 25 mol % | Irgacure-651 | 8% | 5 |
| Example 7 | Toner 7 | 10 mol % | 40 mol % | Irgacure-651 | 2% | 6 |
| Example 8 | Toner 8 | 10 mol % | 40 mol % | Irgacure-651 | 5% | 5 |
| Example 9 | Toner 9 | 10 mol % | 40 mol % | Irgacure-651 | 8% | 4 |
| Example 10 | Toner 10 | 40 mol % | 10 mol % | Irgacure-651 | 2% | 5 |
| Example 11 | Toner 11 | 40 mol % | 10 mol % | Irgacure-651 | 5% | 4 |
| Example 12 | Toner 12 | 40 mol % | 10 mol % | Irgacure-651 | 8% | 3 |
| Example 13 | Toner 13 | 25 mol % | 25 mol % | Irgacure-651 | 2% | 4 |
| Example 14 | Toner 14 | 25 mol % | 25 mol % | Irgacure-651 | 5% | 3 |
| Example 15 | Toner 15 | 25 mol % | 25 mol % | Irgacure-651 | 8% | 2 |
| Example 16 | Toner 16 | 10 mol % | 10 mol % | Irgacure-819 | 2% | 7 |
| Example 17 | Toner 17 | 10 mol % | 10 mol % | Irgacure-819 | 5% | 6 |
| Example 18 | Toner 18 | 10 mol % | 10 mol % | Irgacure-819 | 8% | 5 |
| Example 19 | Toner 19 | 10 mol % | 25 mol % | Irgacure-819 | 2% | 6 |
| Example 20 | Toner 20 | 10 mol % | 25 mol % | Irgacure-819 | 5% | 5 |
| Example 21 | Toner 21 | 10 mol % | 25 mol % | Irgacure-819 | 8% | 4 |
| Example 22 | Toner 22 | 10 mol % | 40 mol % | Irgacure-819 | 2% | 5 |
| Example 23 | Toner 23 | 10 mol % | 40 mol % | Irgacure-819 | 5% | 4 |
| Example 24 | Toner 24 | 10 mol % | 40 mol % | Irgacure-819 | 8% | 3 |
| Example 25 | Toner 25 | 40 mol % | 10 mol % | Irgacure-819 | 2% | 4 |
| Example 26 | Toner 26 | 40 mol % | 10 mol % | Irgacure-819 | 5% | 3 |
| Example 27 | Toner 27 | 40 mol % | 10 mol % | Irgacure-819 | 8% | 2 |
| Example 28 | Toner 28 | 25 mol % | 25 mol % | Irgacure-819 | 2% | 3 |
| Example 29 | Toner 29 | 25 mol % | 25 mol % | Irgacure-819 | 5% | 2 |
| Example 30 | Toner 30 | 25 mol % | 25 mol % | Irgacure-819 | 8% | 1 |
| Comparative Example 1 | Toner 31 | 10 mol % | 0 mol % | Irgacure-651 | 2% | 11 |
| Comparative Example 2 | Toner 32 | 10 mol % | 0 mol % | Irgacure-819 | 2% | 10 |
| Comparative Example 3 | Toner 33 | 0 mol % | 10 mol % | Irgacure-651 | 2% | 13 |
| Comparative Example 4 | Toner 34 | 0 mol % | 10 mol % | Irgacure-819 | 2% | 12 |
| Comparative Example 5 | Toner 35 | 0 mol % | 0 mol % | Irgacure-651 | 2% | 20 |
| Comparative Example 6 | Toner 36 | 0 mol % | 0 mol % | Irgacure-819 | 2% | 18 |
| Comparative Example 7 | Toner 37 | 10 mol % | 10 mol % | Irgacure-651 | 11% | Evaluation is Impossible |
| Example 31 | Toner 38 | 10 mol % | 10 mol % | Irgacure-651 | 0.5% | 9 |
| Example 32 | Toner 39 | 10 mol % | 10 mol % | Irgacure-651 | 8% | 8 |
| Comparative Example 8 | Toner 40 | 10 mol % | 10 mol % | None | — | 15 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a polyester resin that has a glass transition temperature of about 45° C. or higher and in which a proportion of repeating units derived from fumaric acid in repeating units derived from acid components is from 10 mol % and 40 mol % and a proportion of repeating units derived from alkenylsuccinic acid in the repeating units derived from acid components is 10 mol % or greater; and a photopolymerization initiator, wherein a content of the photopolymerization initiator is from about 0.5% by weight to about 10% by weight.

2. The electrostatic charge image developing toner according to claim 1, wherein the repeating unit derived from alkenylsuccinic acid is a repeating unit derived from dodecenylsuccinic acid.

3. The electrostatic charge image developing toner according to claim 1, wherein the photopolymerization initiator is at least one of an alkylphenone-based compound having a melting temperature of 60° C. or higher and an acylphosphine oxide-based compound having a melting temperature of 60° C. or higher.

4. The electrostatic charge image developing toner according to claim 2, wherein the photopolymerization initiator is at least one of an alkylphenone-based compound having a melting temperature of 60° C. or higher and an acylphosphine oxide-based compound having a melting temperature of 60° C. or higher.

5. The electrostatic charge image developing toner according to claim 3, wherein the alkylphenone-based compound is 2,2-dimethoxy-1,2-diphenylethan-1-one, and the acylphosphine oxide-based compound is bis(2,4,6-trimethylbenzoyl)-phenylphosphine oxide.

6. The electrostatic charge image developing toner according to claim 4, wherein the alkylphenone-based compound is 2,2-dimethoxy-1,2-diphenylethan-1-one, and the acylphosphine oxide-based compound is bis(2,4,6-trimethylbenzoyl)-phenylphosphine oxide.

7. The electrostatic charge image developing toner according to claim 1, wherein the solubility of the photopolymerization initiator in water at 25° C. is less than 0.1% by weight.

8. The electrostatic charge image developing toner according to claim 3, wherein the solubility of the photopolymerization initiator in water at 25° C. is less than 0.1% by weight.

9. An electrostatic charge image developer comprising:

the electrostatic charge image developing toner according to claim 1.

10. The electrostatic charge image developer according to claim 9, wherein the photopolymerization initiator of the electrostatic charge image developing toner is at least one of an alkylphenone-based compound having a melting temperature of 60° C. or higher and an acylphosphine oxide-based compound having a melting temperature of 60° C. or higher.

11. The electrostatic charge image developer according to claim 10, wherein the alkylphenone-based compound is 2,2-dimethoxy-1,2-diphenylethan-1-one, and the acylphosphine oxide-based compound is bis(2,4,6-trimethylbenzoyl)-phenylphosphine oxide.

12. A toner cartridge comprising:

a toner accommodation chamber, wherein the toner accommodation chamber contains the electrostatic charge image developing toner according to claim 1.

13. A process cartridge for an image forming apparatus comprising:

a developer holding member; and a developer, wherein the developer is the electrostatic charge image developer according to claim 9.

14. An image forming apparatus comprising:

an image holding member;

a charging unit that charges the image holding member;

an electrostatic charge image forming unit that forms an electrostatic charge image on the charged image holding member;

a developing unit that develops the electrostatic charge image formed on the image holding member as a toner image by using the electrostatic charge image developer according to claim 9;

a transfer unit that transfers the toner image onto a transfer medium;

a fixing unit that fixes the toner image transferred onto the transfer medium on the transfer medium; and a light irradiation unit that irradiates the toner image fixed on the transfer medium with light.

15. The image forming apparatus according to claim 14, wherein the photopolymerization initiator of the electrostatic charge image developing toner in the electrostatic charge image developer is at least one of an alkylphenone-based compound having a melting temperature of 60° C. or higher and an acylphosphine oxide-based compound having a melting temperature of 60° C. or higher.

16. The image forming apparatus according to claim 14, wherein the alkylphenone-based compound is 2,2-dimethoxy-1,2-diphenylethan-1-one, and the acylphosphine oxide-based compound is bis(2,4,6-trimethylbenzoyl)-phenylphosphine oxide.

17. An image forming method comprising:

charging a surface of an image holding member;

forming an electrostatic latent image on the surface of the image holding member;

developing the electrostatic latent image formed on the surface of the image holding member as a toner image by using a developer;

transferring the developed toner image onto a transfer medium;

fixing the toner image transferred onto the transfer medium on the transfer medium; and irradiating the toner image fixed on the transfer medium with light, wherein the developer is the electrostatic charge image developer according to claim 9.

18. The image forming method according to claim 17, wherein the photopolymerization initiator of the electrostatic charge image developing toner in the electrostatic charge image developer is at least one of an alkylphenone-based compound having a melting temperature of 60° C. or higher and an acylphosphine oxide-based compound having a melting temperature of 60° C. or higher.

19. The image forming method according to claim 17, wherein the alkylphenone-based compound is 2,2-dimethoxy-1,2-diphenylethan-1-one, and the acylphosphine oxide-based compound is bis(2,4,6-trimethylbenzoyl)-phenylphosphine oxide.

* * * * *